US009609983B2

(12) United States Patent
McCarthy

(10) Patent No.: US 9,609,983 B2
(45) Date of Patent: Apr. 4, 2017

(54) FACIAL CLEANSING PAD

(71) Applicant: Makeup Eraser Group, LLC, Peoria, AZ (US)

(72) Inventor: Daniel McCarthy, Peoria, AZ (US)

( * ) Notice: Subject to any disclaimer, the term of this patent is extended or adjusted under 35 U.S.C. 154(b) by 0 days.

(21) Appl. No.: 14/936,337

(22) Filed: Nov. 9, 2015

(65) Prior Publication Data

US 2016/0128521 A1 May 12, 2016

Related U.S. Application Data

(60) Provisional application No. 62/077,219, filed on Nov. 8, 2014.

(51) Int. Cl.
*A47K 7/02* (2006.01)
*D04B 1/02* (2006.01)
*D04B 21/02* (2006.01)

(52) U.S. Cl.
CPC ..... *A47K 7/02* (2013.01); *D04B 1/02* (2013.01); *D04B 21/02* (2013.01); *D10B 2509/02* (2013.01)

(58) Field of Classification Search
CPC ..... A47K 7/02; D04B 1/02; D04B 21/145
USPC ..... 15/209.1
See application file for complete search history.

(56) References Cited

U.S. PATENT DOCUMENTS 1,975,260 A * 10/1934 Englander ..... A45D 33/34 15/229.14
2,121,701 A * 6/1938 Landers ..... A46B 5/04 15/104.94
3,317,367 A * 5/1967 Koller ..... B29C 70/12 106/122
3,724,284 A * 4/1973 Eng ..... F16G 5/04 156/140
4,510,641 A * 4/1985 Morris ..... A47L 13/17 15/118
5,119,643 A * 6/1992 Conley ..... D04B 21/02 66/190
5,191,777 A * 3/1993 Schnegg ..... D04B 21/165 66/190
5,490,602 A * 2/1996 Wilson ..... B29C 70/22 156/148
5,503,892 A * 4/1996 Callaway ..... D04B 21/04 15/209.1
5,560,971 A * 10/1996 Emery ..... B32B 5/26 428/911
6,699,540 B1 * 3/2004 Tsukamoto ..... B21F 43/00 245/1
7,013,681 B1 * 3/2006 Ternon ..... D04B 21/165 442/314
D673,746 S * 1/2013 Pung ..... D32/40
2002/0122914 A1 * 9/2002 Rock ..... A41D 3/005 428/85
2005/0081342 A1 * 4/2005 Erickson ..... A44B 18/0049 24/451

(Continued)

*Primary Examiner* — Michael Jennings
(74) *Attorney, Agent, or Firm* — Thomas W. Galvani, P.C.; Thomas W. Galvani

(57) ABSTRACT

A facial cleansing pad includes a body constructed from a pliant fabric and having opposed first and second surfaces. The first surface has a long pile knit finish, preferably an openwork finish, and the second surface has a warp knit finish. The long pile knit finish extends beyond the first surface, and the warp knit finish has no height with respect to the second surface.

14 Claims, 3 Drawing Sheets

(56) References Cited

U.S. PATENT DOCUMENTS

| | | | | |
|---|---|---|---|---|
| 2006/0150331 | A1* | 7/2006 | Child | H05B 3/342 5/502 |
| 2007/0044286 | A1* | 3/2007 | Nohara | D06C 27/00 26/2 R |
| 2008/0014387 | A1* | 1/2008 | Murphy | A61F 13/00991 428/34.1 |
| 2008/0044620 | A1* | 2/2008 | Rock | D03D 15/0077 428/95 |
| 2008/0182470 | A1* | 7/2008 | Fang | D02G 3/443 442/146 |
| 2008/0289129 | A1* | 11/2008 | Kizuka | A47L 13/16 15/118 |
| 2008/0299854 | A1* | 12/2008 | Hilleary | A41D 31/0027 442/136 |
| 2009/0298370 | A1* | 12/2009 | Rock | A41D 31/0027 442/136 |

* cited by examiner

FACIAL CLEANSING PAD

CROSS-REFERENCE TO RELATED APPLICATIONS

This application claims the benefit of U.S. Provisional Application No. 62/077,219, filed Nov. 8, 2014, which is hereby incorporated by reference.

FIELD OF THE INVENTION

The present invention relates generally to hygiene products, and more particularly to pads for cleaning the skin.

BACKGROUND OF THE INVENTION

Cosmetics have been worn by people for thousands of years. The proliferation of synthetic cosmetics products in recent times has only increased the use of makeup, especially among women. There are a variety of types of cosmetics, with facial makeup being one of the most popular, if not the most popular. Facial makeup can be applied throughout the day, but is most frequently applied in the morning, such as after a bath or shower when the face is clean. The facial makeup is worn throughout the day and may be re-applied or touched up during the day, such as after a meal, a drink, before a meeting, before an event, etc. Makeup may be reapplied before a dinner appointment or before going out for entertainment at night. Typically, though, regardless of when the facial makeup is applied or re-applied, most women prefer to not sleep with makeup on their face. There has thus long been a need for women to remove makeup from their face. Depending on the type and amount of makeup, women use different techniques for its removal. Some women simply wash their face with water, others use soap and water, some with water and a towel, others use powered exfoliating brushes, still others use chemical cleansers. Generally, towels or tissues that are used to remove makeup are covered with the makeup and can be extremely difficult to clean. Indeed, many women have a towel reserved for removing makeup because it is so difficult to clean that it is rendered unsuitable for other use, such as a decorative towel or a towel to be used by guests. A simple device for removing makeup is needed.

SUMMARY OF THE INVENTION

A facial cleansing pad includes a body constructed from a pliant fabric and having opposed first and second surfaces. The first surface has a long pile knit finish, preferably an openwork finish, and the second surface has a warp knit finish. The long pile knit finish extends beyond the first surface, and the warp knit finish has no height with respect to the second surface. The body includes opposed major sides and opposed minor ends. The major sides are coextensive to each other and longer than the minor ends, and the minor ends are coextensive to each other. The major sides are parallel to each other and perpendicular to the minor ends, and the minor ends are parallel to each other. The pad also has a perimeter with an oval configuration. Edging constructed from a smooth inelastic fabric is sewn to the perimeter. The edging is secured to the perimeter with stitching through the first and second surfaces. The second surface is defined by having an openwork finish. The fabric of the pad has a weight-area density of 285 grams per square meter, and is constructed from two threads plied together, having the property of 150 deniers per 288 feet and 100 deniers per 36 feet, respectively.

BRIEF DESCRIPTION OF THE DRAWINGS

Referring to the drawings.

DETAILED DESCRIPTION

Figure 1:
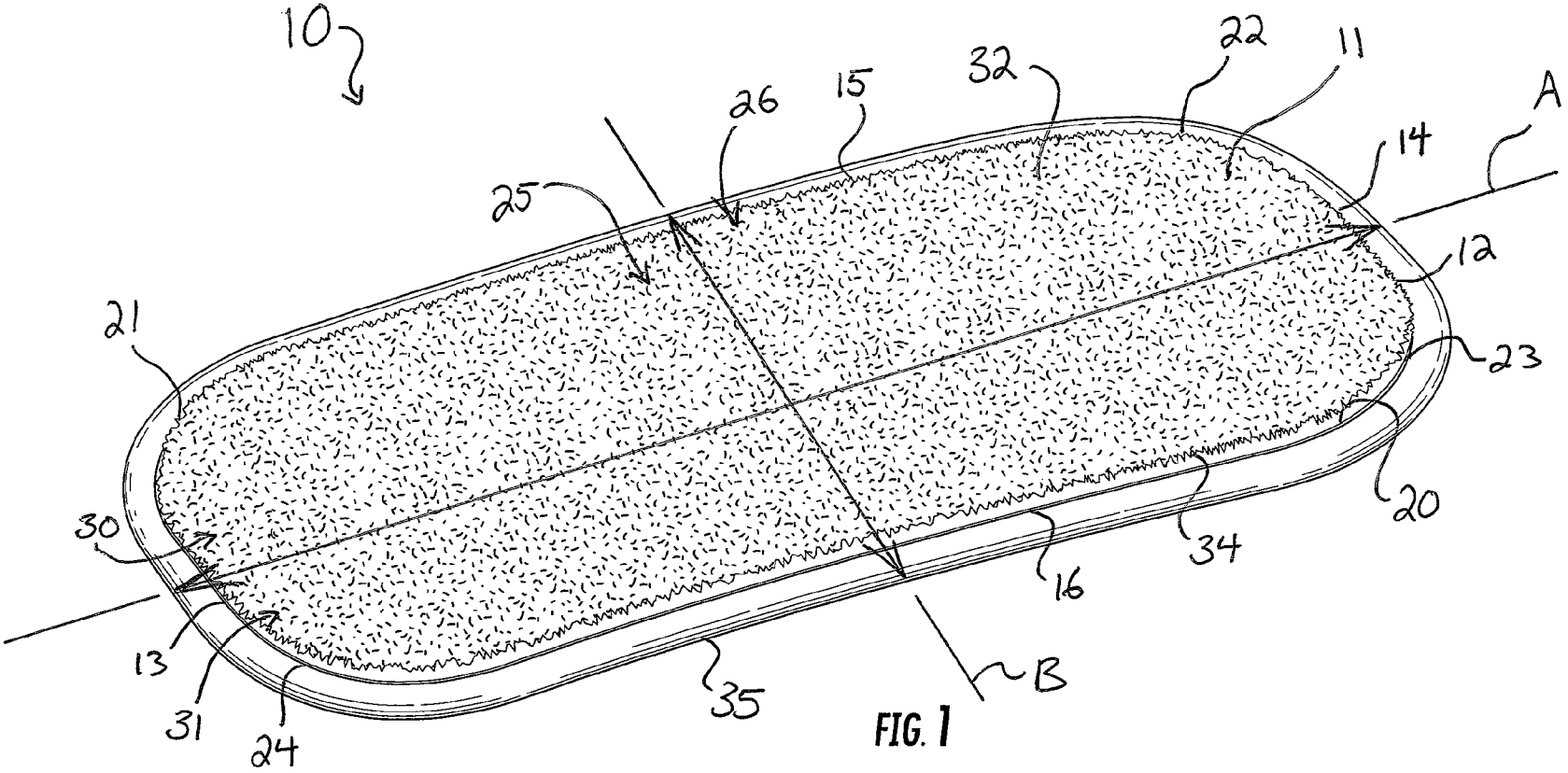
FIG. 1 is a top perspective view of a facial cleansing pad.
Figure 2:
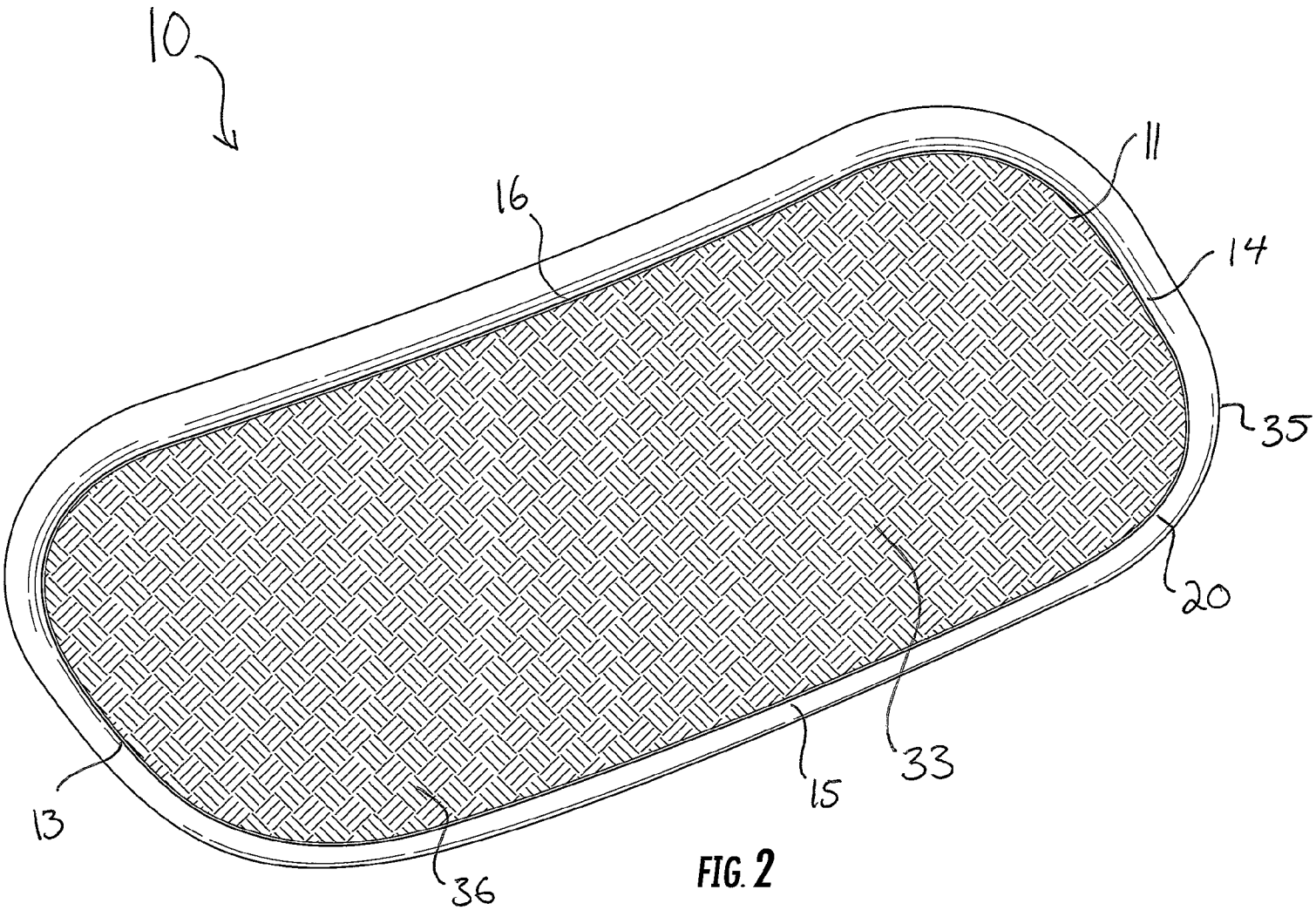
FIG. 2 is a bottom perspective view of the facial cleansing pad of FIG. 1.
Figure 3:
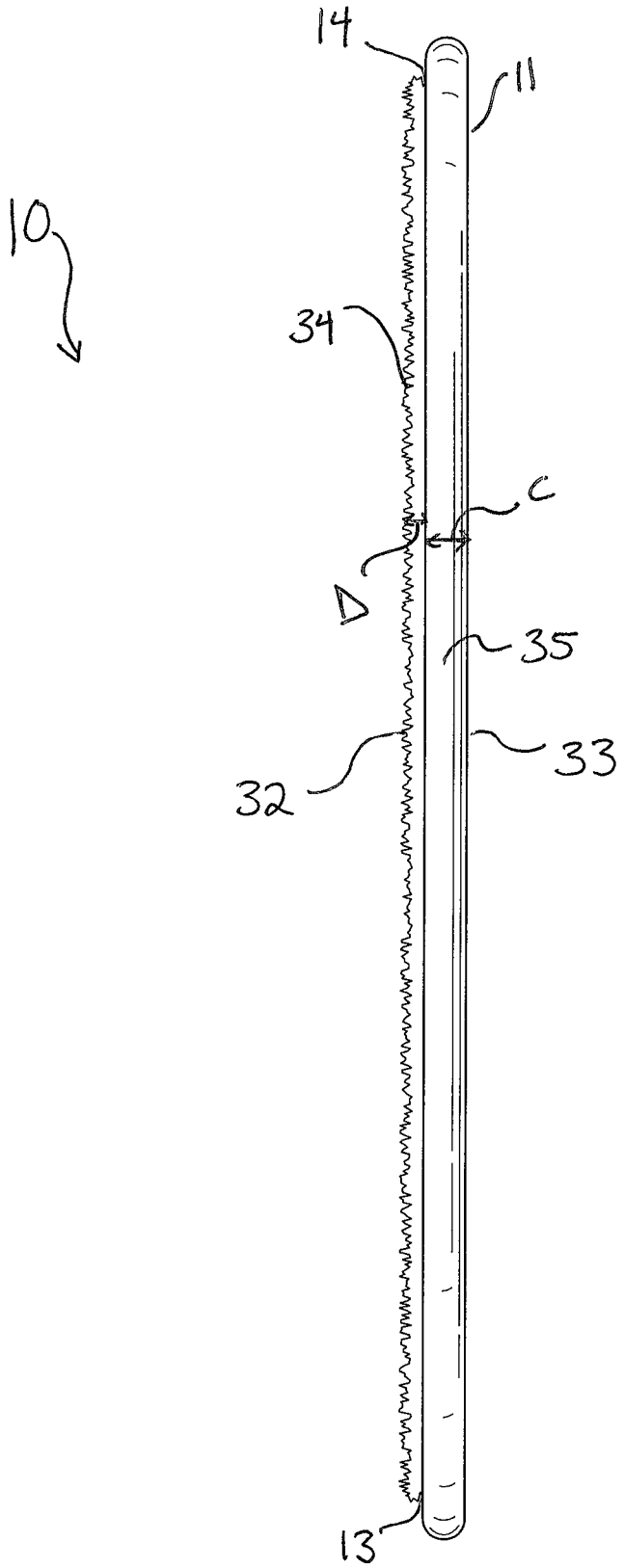
FIG. 3 is a side elevation view of the facial cleansing pad of FIG. 1.

Reference now is made to the drawings, in which the same reference characters are used throughout the different figures to designate the same elements. FIGS. 1-3 illustrate a facial cleansing pad 10 (hereinafter, the "pad 10") useful for quickly, efficiently, and reusably cleaning dirt, makeup, and other markings from the face and skin of a user. The pad 10 has a body 11 formed from a single, continuous monolithic base sheet 12 of material. The body 11 is a flat, thin, and generally elongate rectangular-shaped item when viewed from a top or bottom plan perspective, as shown in FIGS. 1 and 2.

Referring now primarily to FIG. 1, the body has opposed minor sides, or ends 13 and 14, and opposed major sides, or sides 15 and 16, extending between the opposed ends 13 and 14. The ends 13 and 14 cooperate with the sides 15 and 16 to define a continuous perimeter 20 of the body 11. The ends 13 and 14 are short, coextensive, and parallel with respect to each other. The sides 15 and 16 are long, coextensive, parallel with respect to each other, and perpendicular to the ends 13 and 14. The ends 13 and 14 and sides 15 and 16 meet at four rounded corners, which also define the perimeter 20. A corner 21 joins the end 13 with the side 15, a corner 22 joins the end 14 with the side 15, a corner 23 joins the end 14 with the side 16, and a corner 24 joins the end 13 with the side 16. Each of the corners 21, 22, 23, and is quarter round. Thus, while the body 11 is generally elongate, the perimeter 20 is substantially oval-shaped.

The body 11 has symmetry with respect to both a first, or major axis A, and a second, or minor axis B, both shown in FIG. 1. The major axis A bisects the body 11 into two major halves, generally indicated by the reference characters 25 and 26, respectively. The major half 25 includes the body 11 and base sheet 12 extending from the axis B to the end 13, and the major half 26 is opposed, extending from the axis B to the end 14. The major halves 25 and 26 are identical in size and shape.

The second axis B bisects the body 11 into two minor halves, generally indicated by the reference characters 30 and 31. The minor half 30 includes the body 11 and base sheet 12 extending from the axis A to the side 15, and the minor half 31 includes the body 11 and base sheet 12 extending from the axis A to the side 16. The minor halves 30 and 31 are identical in size and shape.

The pad 10 is constructed from a flexible, pliant, soft material, such as cotton, polypropylene, nylon, or like material. The base sheet 12 is preferably formed entirely from a single, continuous sheet of polyester. Generally, individual base sheets 12 are cut from a long, continuous sheet of the constituent fabric, and each is formed into a pad 10. The fabric has a surface density in the range of approximately 200 grams per square meter to 250 grams per square meter, and is preferably 285 grams per square meter. The fabric is woven of two plied threads having a metric number per single yarn of fabric is 150 deniers per 288 feet and 100 deniers per 36 feet, respectively.

Referring now to FIG. 1 and FIG. 2, the body 11 has opposed first and second surfaces 32 and 33. The first surface 32 is a "top" surface 32, and the second surface 33 is a "bottom" surface 33. The top surface 32 is coextensive to the bottom surface 32. The body 11 is formed from a plurality of fibers woven together to form the continuous, integral base sheet 12. Referring also now to FIG. 3, the first surface 32 includes a plurality of fiber ends extending outwardly from the base sheet 11, forming a soft and dense pile 34. The pile 34 is characterized by a long pile knit finish. The fibers are linked with a continuous chain of circular stitches through the base sheet 11 and are finished with a soft end, providing the top surface 32 with a consistent, dense, and soft texture. The bottom surface 33 is defined by an openwork warp knit finish 36.

Referring to FIG. 3, the body 11 has a thickness C extending between the top surface 32 and the bottom surface 33. Thickness C is uniform across the entire body 11 from the end 13 to the end 14, and from the side 15 to the side 16. The finish 36 on the bottom surface 33 extends no further past the bottom surface 33. In other words, the finish 36 has no height with respect to the bottom surface 33 it is carried on. The pile 34 on the top surface 32, however, does have height. The pile 34 extends beyond the top surface by a distance; it has a height D with respect to the top surface 32. The height D is approximately one-third the thickness C.

A smooth fabric is sewn to the perimeter 20 to form a continuous edging 35 for the pad 10. The edging 35 is secured on the body 11 with stitching through the top and bottom surfaces 32 and 33 so that the edging 35 contains any loose or frayed edges, fibers, or other matter of the base sheet 12 from pulling off the base sheet 12. The fabric from which the edging 35 is constructed is inelastic. Thus, the edging 35 prevents the pad 10 from stretching along either of the axes A and B. In contrast, the fabric of the base sheet 12 is elastic, and is capable of stretching along either of the axes A and B as well as out of a plane defined by the axes A and B; elastic stretching of the base sheet 12 is limited by the inelastic edging 35.

In operation, the pad 10 is preferably washed thoroughly, such as in a machine wash, prior to use. The user applies water to the pad 10, such water preferably being warm. The pad 10 is then applied to the user's face and is pressed against the face while moving the pad 10 in a circular motion so as to remove makeup from the face of the user. When the makeup has been entirely removed, the pad 10 is washed, again, such as in a machine wash. When the wash is complete, the pad 10 is ready for re-use.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A facial cleansing pad comprising:

a single body constructed from a pliant woven, soft fabric and including an exposed first surface and an opposed exposed second surface, the body having a thickness extending between the first and second surfaces;

the fabric comprising a plurality of fibers woven together to define the body as continuous and integral;

the first surface having a long pile knit finish thereon, the long pile knit finish comprising free ends of the plurality of the fibers and extending to a height beyond the first surface approximately one-third of the thickness of the body;

the second surface having a warp knit finish thereon, the warp knit finish having a height not extending beyond the second surface;

an edging sewn to the body about a perimeter of the body; and the fabric of the body being elastic, and the edging on the body being an inelastic fabric.

2. The facial cleansing pad of claim 1, wherein:

the body includes opposed major sides and opposed minor ends;

the major sides are coextensive to each other and longer than the minor ends;

the minor ends are coextensive to each other;

the major sides are parallel to each other and perpendicular to the minor ends; and the minor ends are parallel to each other.

3. The facial cleansing pad of claim 1, wherein the perimeter has an oval configuration.

4. The facial cleansing pad of claim 1, wherein the edging is secured to the perimeter with stitching through the first and second surfaces.

5. The facial cleansing pad of claim 1, wherein the second surface is further defined by having an openwork finish.

6. The facial cleansing pad of claim 1, wherein the fabric has a weight-area density of 285 grams per square meter.

7. The facial cleansing pad of claim 1, wherein the fabric is constructed from two threads plied together, having the property of 150 deniers per 288 feet and 100 deniers per 36 feet, respectively.

8. A facial cleansing pad comprising:

a thin, elongate body constructed from a plurality of fibers integrally woven together into a continuous, pliant, woven, and soft fabric and including a first surface and an opposed second surface, the body having a thickness extending between the first and second surfaces;

the first surface having a long pile knit finish thereon, the long pile knit finish comprising free ends of the plurality of the fibers, which long pile knit finish has a height with respect to the first surface one-third of the thickness of the body;

the second surface having a warp knit finish thereon, which warp knit finish has no height with respect to the second surface;

an edging sewn to the body about a perimeter of the body; and the fabric of the body being elastic, and the edging on the body being an inelastic fabric.

9. The facial cleansing pad of claim 8, wherein:

the body includes opposed major sides and opposed minor sides;

the major sides are coextensive to each other and longer than the minor sides;

the minor sides are coextensive to each other;

the major sides are parallel to each other and perpendicular to the minor sides; and the minor sides are parallel to each other.

10. The facial cleansing pad of claim 8, a wherein the perimeter has an oval configuration.

11. The facial cleansing pad of claim 8, wherein the edging is secured to the perimeter with stitching through the first and second surfaces.

12. The facial cleansing pad of claim 8, wherein the second surface is further defined by having an openwork finish.

13. The facial cleansing pad of claim 8, wherein the fabric has a weight-area density of 285 grams per square meter.

14. The facial cleansing pad of claim 8, wherein the fabric is constructed from two threads plied together, having the property of 150 deniers per 288 feet and 100 deniers per 36 feet, respectively.

* * * * *